US010472903B2

(12) United States Patent
Kunec

(10) Patent No.: US 10,472,903 B2
(45) Date of Patent: Nov. 12, 2019

(54) RACKING BOARD RETENTION SYSTEM

(71) Applicant: Nabors Drilling Technologies USA, Inc., Houston, TX (US)

(72) Inventor: Alex Kunec, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

(21) Appl. No.: 16/109,486

(22) Filed: Aug. 22, 2018

(65) Prior Publication Data

US 2019/0063167 A1 Feb. 28, 2019

Related U.S. Application Data

(60) Provisional application No. 62/549,223, filed on Aug. 23, 2017.

(51) Int. Cl.
*E21B 19/14* (2006.01)

(52) U.S. Cl.
CPC ..... *E21B 19/14* (2013.01)

(58) Field of Classification Search
CPC ..... E21B 19/14; E21B 19/15; E21B 19/155; E21B 19/18; E21B 19/20; B65H 2402/5155; F16L 3/00
USPC ..... 414/22.51–22.71
See application file for complete search history.

(56) References Cited

U.S. PATENT DOCUMENTS

| | | | | |
|---|---|---|---|---|
| 1,718,395 | A * | 6/1929 | Webb | E21B 19/14 211/70.4 |
| 2,619,234 | A * | 11/1952 | Stone | E21B 19/14 211/4 |
| 2,900,925 | A * | 8/1959 | Dunlap | B61D 45/001 403/81 |
| 3,799,364 | A * | 3/1974 | Kelly | E21B 19/14 175/85 |
| 7,083,007 | B2 * | 8/2006 | Herst | E21B 19/14 141/258 |
| 8,827,008 | B2 * | 9/2014 | Hankins | E21B 19/14 175/161 |
| 2013/0032405 | A1 * | 2/2013 | Braxton | E21B 19/14 175/57 |
| 2016/0076920 | A1 * | 3/2016 | Newton | E21B 47/011 248/65 |

* cited by examiner

*Primary Examiner* — Lynn E Schwenning
(74) *Attorney, Agent, or Firm* — Adolph Locklar

(57) ABSTRACT

A fingerboard that includes a first finger having a longitudinal axis and proximal and distal ends, a latch assembly mounted on the distal end of the finger, the latch assembly including first and second opposed bearing faces defining a first gap therebetween, a latch having first and second latch ends, the first latch end being pivotably mounted in the first gap so as to allow the latch to pivot between open and closed positions in a plane normal to the longitudinal axis of the first finger, and third and fourth opposed bearing faces defining a second gap therebetween, the second longitudinal space positioned to receive the second end of corresponding latch on an adjacent finger. The latch assembly may be detachably mounted on the finger.

24 Claims, 5 Drawing Sheets

RACKING BOARD RETENTION SYSTEM

CROSS-REFERENCE TO RELATED APPLICATION

This application is a nonprovisional application that claims priority from U.S. provisional application No. 62/549,223, filed Aug. 23, 2017, the entirety of which is hereby incorporated by reference.

TECHNICAL FIELD/FIELD OF THE DISCLOSURE

The present disclosure relates generally to methods for drilling system equipment and specifically to methods of racking tubulars on a drilling rig.

BACKGROUND OF THE DISCLOSURE

Systems for drilling and operating oil and gas wells include various types of piping, referred to generally as "tubulars." Tubulars may include drill pipe, casing, production tubing and other threadably connectable oil and gas well structures. Drill pipe may be used and stored as sections, or "stands," of two or more individual tubulars connected together. Multiple stands may be stored vertically on the drilling rig. The pipe stands are typically placed upright on the drillfloor, with their upper ends held in place by a structure known as a fingerboard. A fingerboard typically includes a plurality of elongated "fingers," with each space between adjacent fingers capable of receiving multiple stands of pipe. The fingerboards separate the stored pipe stands into rows and prevent the pipe stands from falling over. Rather than balancing upright, individual pipe stands may lean within the fingerboard.

SUMMARY

The disclosure includes a fingerboard. The fingerboard may include a first finger having a longitudinal axis and proximal and distal ends, and a latch assembly mounted on the distal end of the finger. The latch assembly may include first and second opposed bearing faces defining a first gap therebetween; a latch having first and second latch ends, the first latch end being pivotably mounted in the first gap so as to allow the latch to pivot between open and closed positions in a plane normal to the longitudinal axis of the first finger, and third and fourth opposed bearing faces defining a second gap therebetween, the second longitudinal space positioned to receive the second end of a similar latch on an adjacent finger. The latch assembly may include a pin parallel to the longitudinal axis and the first latch end may include a bore and the first latch end may be pivotably mounted on the first finger by engagement of the pin with the bore. The longitudinal dimension of the first gap may be greater than the longitudinal dimension of the first latch end. The fingerboard may further include a first centralizer positioned between the first bearing face and the first latch end and a second centralizer positioned between the second bearing face and the first latch end. The fingerboard may include multiple fingers and each finger may include a single latch assembly. The latch assembly may be releasably mounted. The fingerboard may further include a control system and a pipe sensor mounted on the first finger, the pipe sensor having a sensing range such that a pipe received in the slot and in contact with the latch is within the sensing range of the pipe sensor, the pipe sensor being in communication with the control system.

The fingerboard may further include a latch actuator connected to the latch such that when latch actuator is actuated, it causes the latch to move to an open position and further including a sensor for sending a signal indicative of the position to the control system. The latch may be elastic.

In some embodiments, the fingerboard may include a first finger having a longitudinal axis, a pin parallel to the longitudinal axis, and may include first and second opposed bearing faces. The latch may have first and second latch ends and the first latch end may include a bore. The latch may be pivotably mounted between the first and second bearing faces by engagement of the pin with the bore so as to allow the latch to pivot between open and closed positions in a plane normal to the longitudinal axis of the first finger. The distance between the first and second bearing faces may be greater than the longitudinal dimension of the first latch end. A first centralizer may be positioned between the first bearing face and the first latch end and a second centralizer may be positioned between the second bearing face and the first latch end.

The fingerboard may include a second finger parallel to the first finger and defining a slot therewith. The second finger may include third and fourth bearing faces that are positioned such that when the latch is in a closed position the second latch end lies between the third and fourth bearing faces. The fingerboard may further include a control system and a pipe sensor mounted on the first finger and having a sensing range such that a pipe received in the slot and in contact with the latch is within the sensing range of the pipe sensor, the pipe sensor being in communication with the control system. The fingerboard may further include a latch actuator connected to the latch such that when latch actuator is actuated, the latch actuator causes the latch to move to an open position. The fingerboard may also include a sensor for sending a signal indicative of the position to the control system.

A method for storing tubulars at a drill site may include the steps of providing a fingerboard comprising a first finger having a longitudinal axis and including first and second opposed bearing faces, a latch having first and second latch ends, the first latch end being pivotably mounted between the first and second bearing faces so as to allow the latch to pivot between open and closed positions in a plane normal to the longitudinal axis of the first finger; and a second finger parallel to the first finger and defining a slot therebetween, the second finger including third and fourth bearing faces positioned such that when the latch is in a closed position the second latch end lies between the third and fourth bearing faces, opening the latch, inserting one end of a tubular into the slot between the first and second fingers, and closing the latch.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
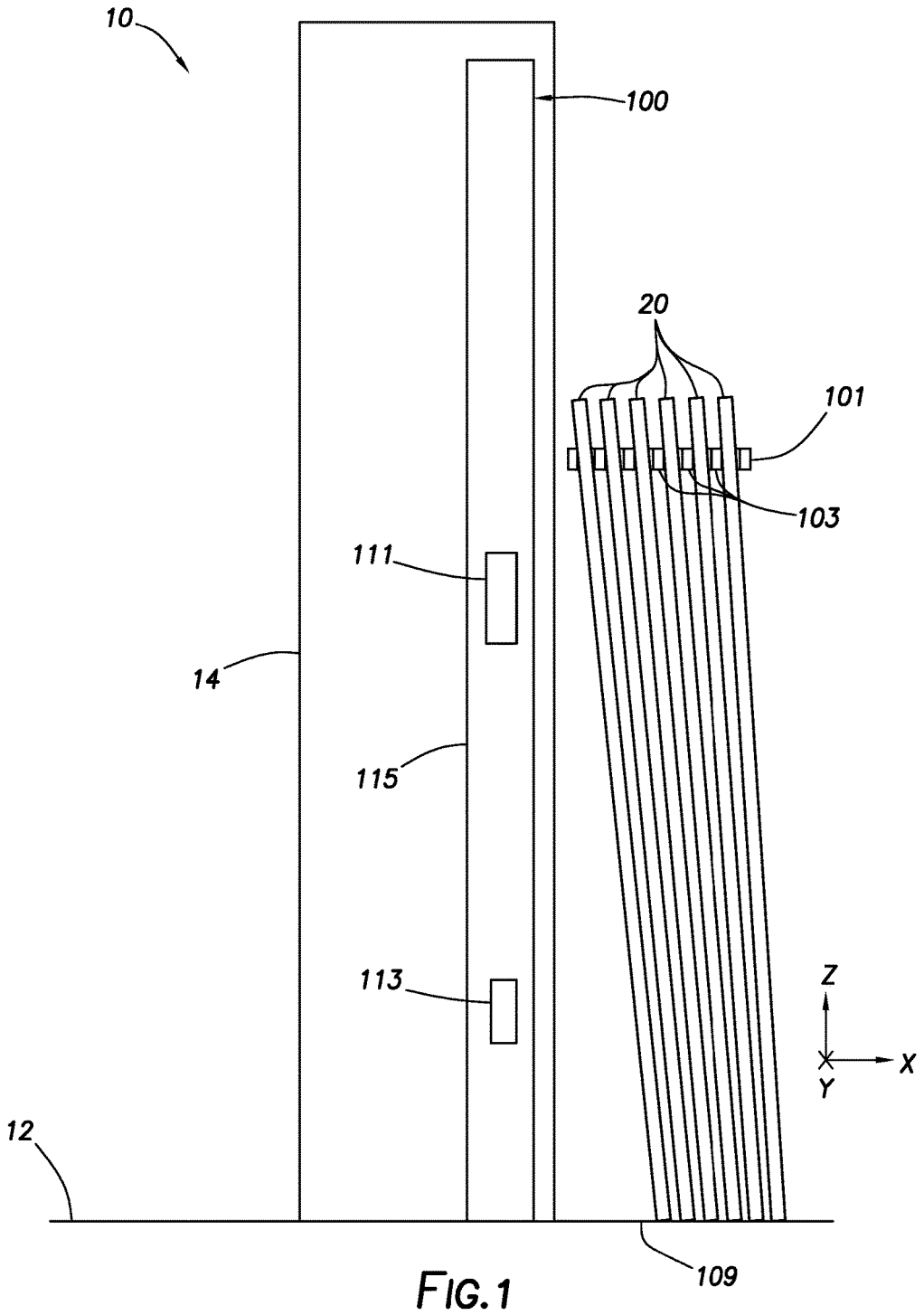
FIG. 1 is a schematic illustration of a drill site incorporating a fingerboard.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. For the purposes of this disclosure, the following coordinate system will be used for the sake of clarity in the disclosure. As drawn in FIG. 1, the "X axis" or "X direction" is defined as extending horizontally in the plane of the page, the "Y axis" or "Y direction" is defined as extending horizontally in a plane normal to the page, and the "Z axis" or "Z direction" is defined as the vertical axis.

FIG. 1 schematically depicts a drilling system 10 consistent with at least one embodiment of the present disclosure. Drilling system 10 may include drillfloor 12 and mast 14. Drilling system 10 may further include a pipe handling apparatus 100 and a fingerboard 101. Fingerboard 101 may be used to support one or more pipe stands 20. In some embodiments, pipe handling apparatus 100 may include an upper grabber 111 and a lower grabber 113 on a pipe handling column 115. Upper grabber 111 and lower grabber 113 may be extendable from pipe handling column 115 and may be adapted to cooperate to move individual stands of pipe into or out of slots in fingerboard 101. When pipe stands 20 are stored in fingerboard 101, the lower end of each pipe stands 20 may rest on a setback 109 on drill floor 12.

Figure 2:
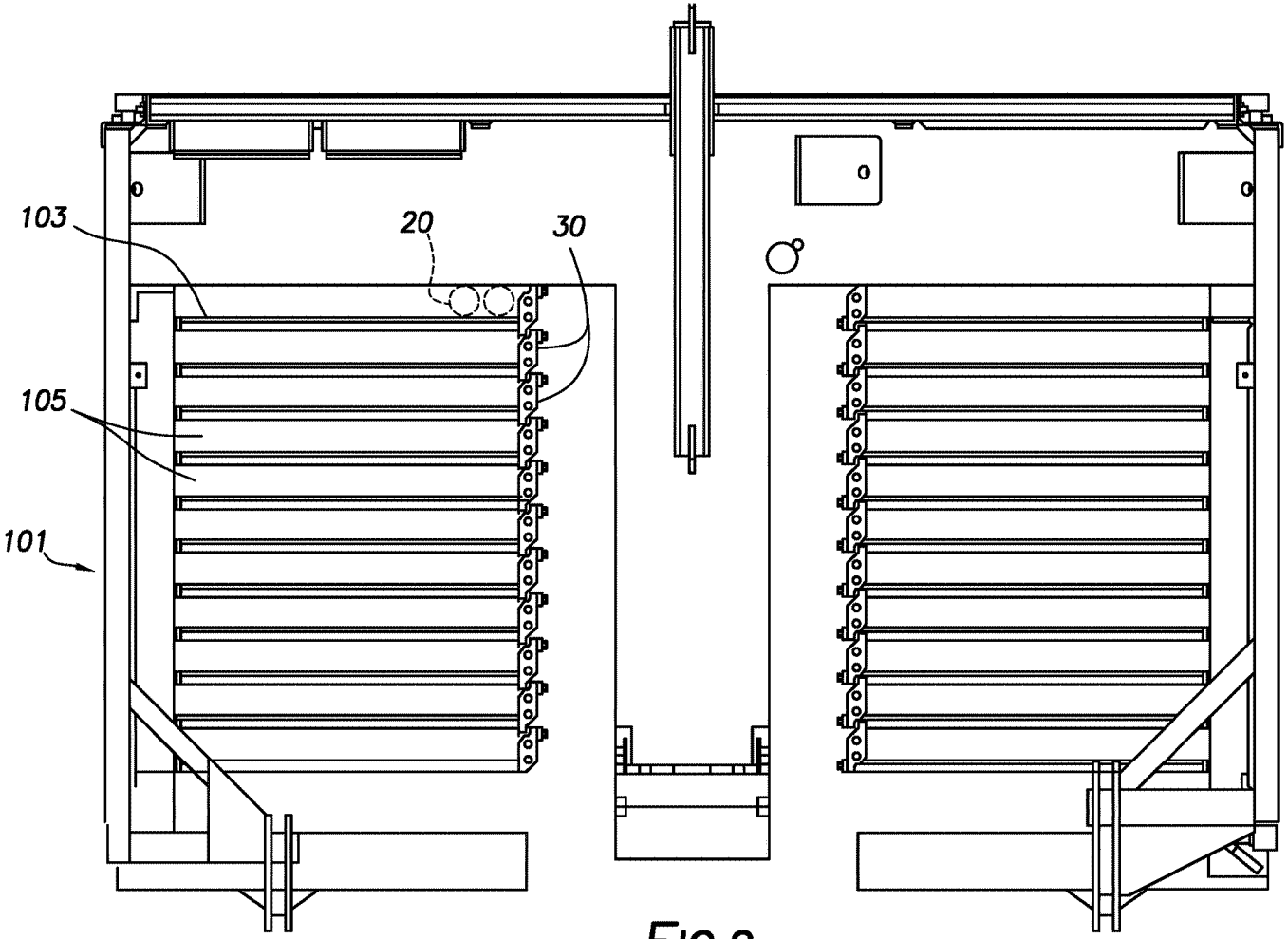
FIG. 2 depicts a plan view of a fingerboard consistent with at least one embodiment of the present disclosure.

Referring now also to FIG. 2, fingerboard 101 may include elongate fingers 103, with each pair of adjacent fingers 103 defining a pipe-receiving rack slot 105 therebetween. A latch 30 may be mounted at the end of each finger 103. Each latch 30 is designed to retain pipe stands (tubulars) 20 in a respective slot 105. Operations in which the presently described drilling system 10 may be used include, but are not limited to, pipe stand preparation and tripping in and out of the wellbore. Pipe stands 20 may be placed into fingerboard 101 from a wellbore, mouse hole, v-door, slide, catwalk, or any other rig structure.

Figure 3:
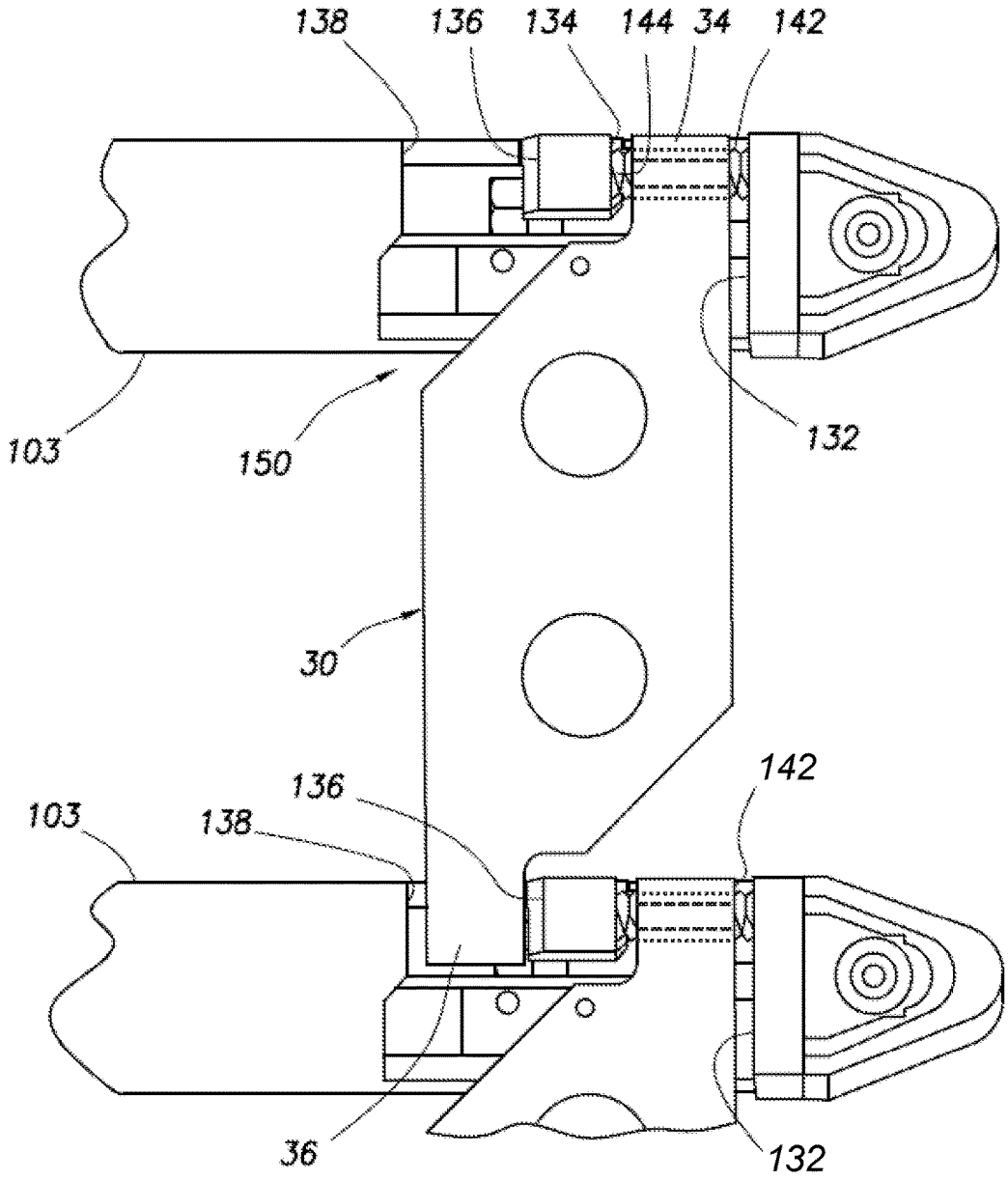
FIG. 3 depicts a plan view of a latch for a fingerboard consistent with at least one embodiment of the present disclosure.
Figure 4:
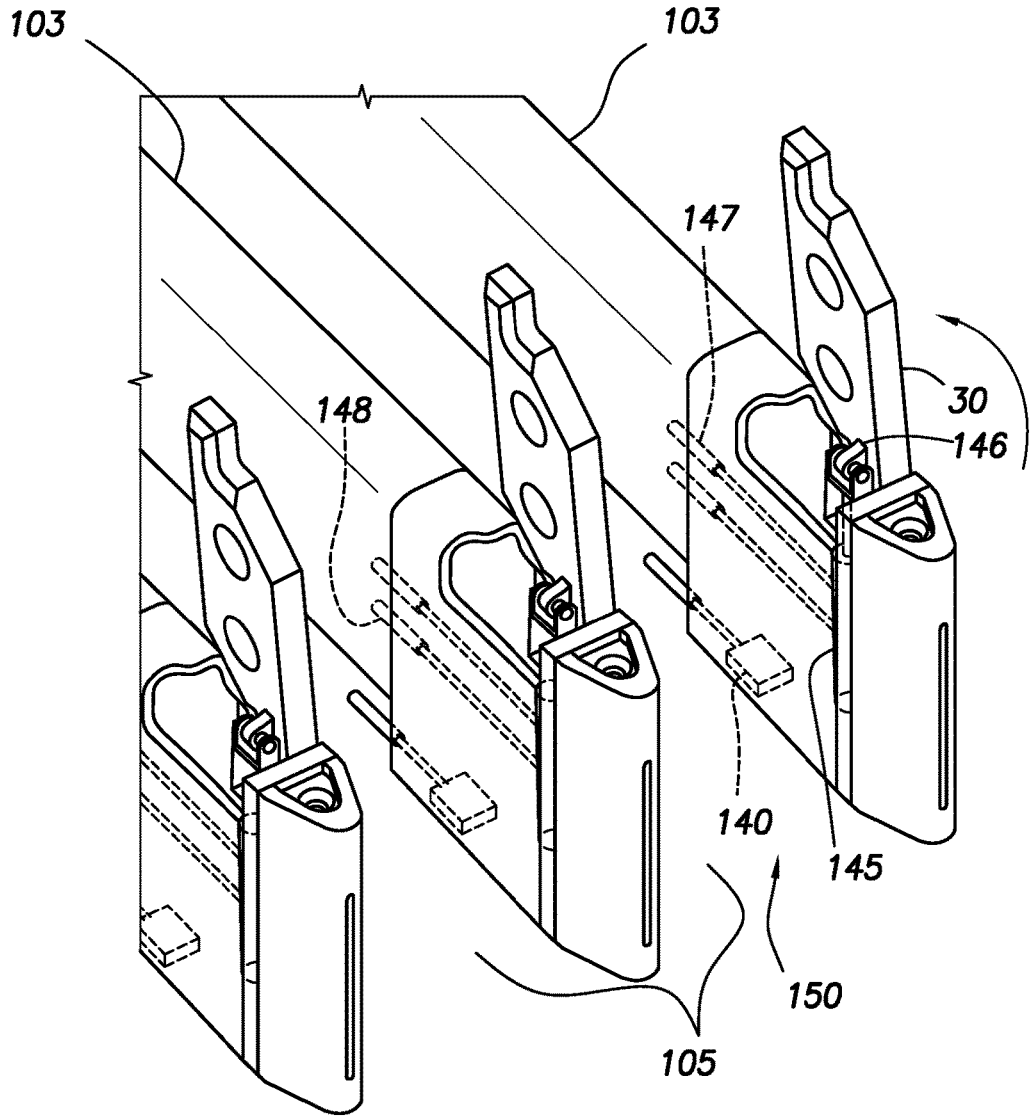
FIG. 4 depicts a partial cutaway perspective view of a plurality of latches consistent with at least one embodiment of the present disclosure.
Figure 5:
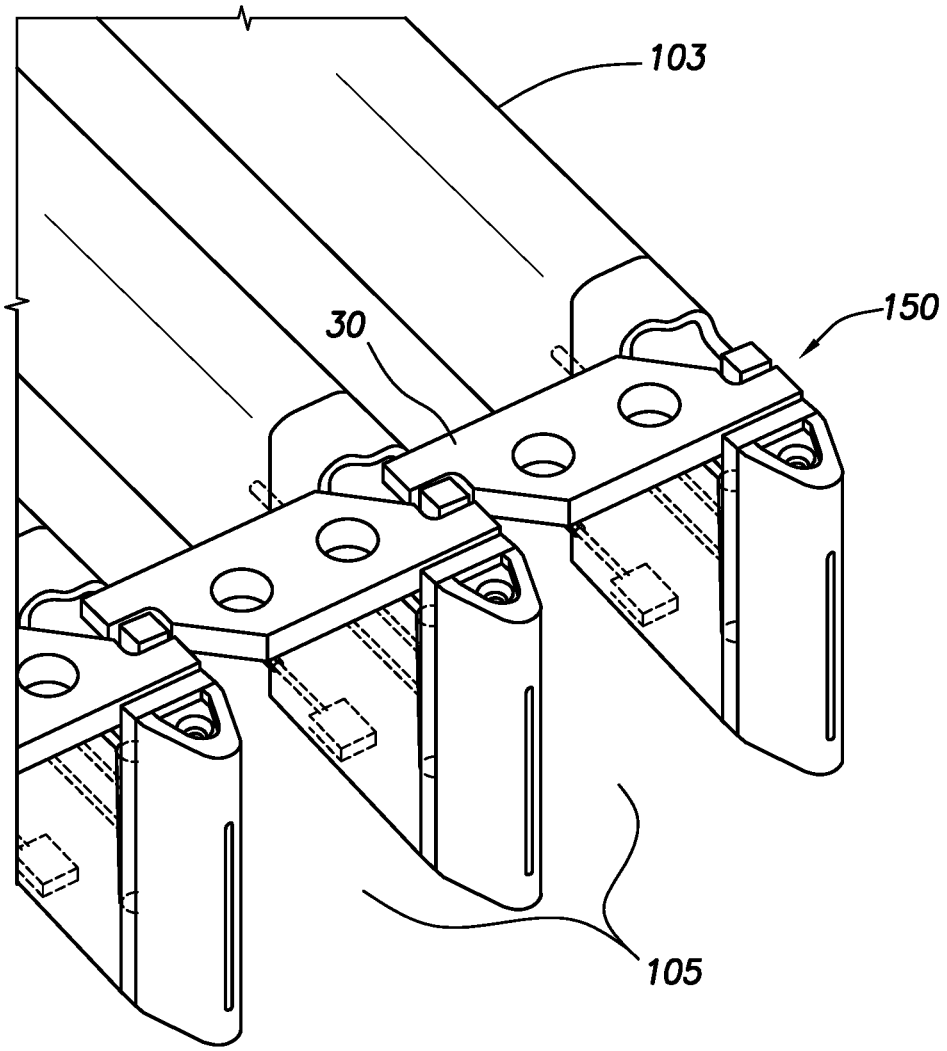
FIG. 5 depicts a partial cutaway perspective view of the plurality of latches of FIG. 4 in an alternate position.

Referring now to FIGS. 3-5, each finger 103 has a longitudinal axis and may include a first bearing face 132, a second bearing face 134, a third bearing face 136, and a fourth bearing face 138. First and second bearing faces 132, 134 oppose each other in a direction parallel to the longitudinal axis and define a first gap therebetween, with first bearing face 132 oriented toward the proximal end of finger 103 and second bearing face 134 oriented toward the distal end of finger 103. Likewise, third and fourth bearing faces 136, 138 oppose each other in a direction parallel to the longitudinal axis and define a second gap therebetween, with third bearing face 136 oriented toward the proximal end of finger 103 and fourth bearing face 138 oriented toward the distal end of finger 103. The first gap may be axially spaced from the second gap in a direction parallel to the longitudinal axis.

A latch 30 may be mounted on finger 103 and may include a first latch end 34 and a second latch end 36. Latch 30 may be configured such that first and second latch ends 34, 36 are offset from each other in a direction parallel to the longitudinal axis.

First latch end 34 of latch 30 may be pivotably mounted between first and second bearing faces 132, 134. For example, first latch end 34 may include a bore (shown in phantom in FIG. 3) therethrough and may be mounted on finger 103 by means of a pin (shown in phantom in FIG. 3) passing through the bore and mounted between first and second bearing faces 132, 134. The pin may be parallel to the longitudinal axis of finger 103 such that when latch 30 rotates on the pin, latch 30 rotates in a plane that is normal to the axis of finger 103. First and second bearing faces 132, 134 may be constructed such that the distance between them is greater than the longitudinal dimension of first latch end 34, which may allow latch 30 to shift or slide along the pin in a longitudinal direction. Other forms of pivotable mount, i.e., mounts that allow rotation but not lateral movement are suitable for and within the scope of the present disclosure. The pivotable mount may but need not allow longitudinal movement.

In some embodiments, one or more of pivotable latch 30, and bearing faces 132, 134, 136, 138, may form a latch assembly 150 that is detachably mounted at the end of finger 103. As the components of the latch assembly are more likely to incur damage than the rest of the finger, it may be desirable to releasably mount each latch assembly 150 on its respective finger so as to facilitate replacement of damaged or malfunctioning latch assembly components. The releasable connection may be a T-slot, bayonet, or other releasable mechanical connection.

When latch 30 is in a position that does not prevent passage of a tubular into or out of slot 105, as illustrated in FIG. 4, the latch is referred to as "open." When latch 30 is in a position that does prevent passage of a tubular into or out of slot 105, as illustrated in FIG. 5, the latch is referred to as "closed."

Referring again to FIGS. 3-5, in some embodiments, a first spring 142 or other centralizer may be positioned on the pin between first bearing face 132 and first latch end 34 and a second spring 144 or other centralizer may be positioned on the pin between first latch end 34 and second bearing face 134. Springs 142, 144 may each be in compression when mounted and may be configured such that when no external force is applied to latch 30, there is a space between first latch end 34 and each bearing face 132, 134. Regardless of whether springs 142, 144 are included, when a force having a component parallel to the pin axis, hereinafter called a longitudinal force, is applied to latch 30, latch 30 slides along the pin until the respective centralizer is fully compressed, whereby the longitudinal force is transferred to the respective bearing face (132 or 134). In some embodiments, one or both of springs 142, 144 may, for example and without limitation, prevent or reduce the likelihood that latch 30 does not reliably enter the second gap as latch 30 is closed.

Similarly, third and fourth bearing faces 136, 138 on finger 103 are positioned such that when latch 30 is closed, second latch end 36 is received between third bearing face 136 and fourth bearing face 138. As at first latch end 34, when a longitudinal force is applied to latch 30, latch 30 shifts longitudinally in the direction of the longitudinal force until it bears on the respective bearing face 136 or 138.

In addition to centering first latch end 34 between bearing faces 132, 134, springs 142, 144 serve to absorb some of the impact energy in the event that a tubular falls against latch 30, thereby reducing the risk of damage to the latch assembly or finger 103. In some embodiments, either alternatively or in addition, latch 30 may be made of a material that has some elasticity and is therefore able to absorb at least a portion of the energy from a tubular impact on latch 30. For example and without limitation, latch 30 may be formed from a rubber or polymer such as, for example and without limitation, rubber, ultra high molecular weight polyethylene (UHMWPE), urethane, or other such material. In some embodiments, latch 30 may be formed, for example and without limitation, from a material having an elastic modulus of between 30 and 1000 MPa.

Referring particularly to FIG. 4, each finger 103 that supports a latch 30 may include a pipe sensor 140 that is capable of detecting the presence or passage of a tubular within the sensing range of pipe sensor 140. Pipe sensor 140 may operate by any suitable means such as magnetic field sensing, photo-sensing, acoustic sensing, mechanical sensing, or the like. Finger 103 may further include an actuator 145 that mechanically engages latch 30 via an arm 146 or other suitable means such that when actuator 145 is triggered, it moves latch 30 from an open position to a closed position or vice versa. Finger 103 may also include first and second sensors 147, 148, which are configured to provide an output indicative of whether actuator 145 is open or closed, respectively, and thus indicate the position of latch 30. Sensors 140, 147, 148 may be connected by conventional means to a rig control system.

If present, pipe sensor 140, actuator 145, arm 146, and first and second sensors 147, 148 may be included in latch assembly 150.

Latch assembly 150 may be configured such that latch 30 is normally closed. By way of example, latch 30, actuator 145 and actuator arm 146 may be configured such that if no opening force is applied to actuator 145, gravity will cause latch 30 to fall into a closed position. Alternatively or in addition, latch assembly 150 may include an additional closing mechanism, such as a spring, that normally applies a force urging latch 30 into a closed position.

When it is desired to rack a pipe stand, i.e., to store it in a generally upright position with its upper end retained in fingerboard 101, the pipe handling equipment on the rig positions the pipe stand at the desired location and the upper end of the pipe stand is guided into the desired slot 105. If the latch 30 of that slot is closed, actuator 145 can be used to shift latch 30 to its open position so that the pipe can enter the slot. If desired, the passage of a pipe past pipe sensor 140 may cause actuator 145 to re-close latch 30. If desired, latch 30 may default to a closed position and may be opened only for a predetermined amount of time, or only for so long as a signal is received by actuator 145. In any event, when there is at least one tubular stored in a given slot, latch 30 may be closed in order to retain the tubular.

As will be understood from the present disclosure, if latch 30 were closed and one or more stored tubulars were to fall or lean against latch 30, a portion of the impact energy would be absorbed by elasticity in springs 142, 144 and/or latch 30, if those components were elastic, and the longitudinal load would ultimately be transferred from latch 30 to both bearing face 132 (via spring 142, if present) and bearing face 134 of the adjacent finger. Similarly, if latch 30 were closed and one or more tubulars were to fall or lean against the outside of latch 30, the resulting longitudinal load would be transferred from latch 30 to bearing face 134 (via spring 144, if present) and bearing face 138 of the adjacent finger.

It will be understood that each adjacent pair of fingers 103 in a fingerboard can be configured as disclosed above, so that each latch 30 is supported by both the finger on which it is mounted and an adjacent finger when in a closed position. Because the pairs of bearing faces 132, 134 and 136, 138 provide mechanical support for first and second latch ends 34 and 36 of latch 30, respectively, no torque is applied to the latch 30 or the latch mounting system when it is retaining a tubular and it is possible to use a lighter mounting system. Likewise, because the present system transfers a longitudinal load on the latch to the fingers by placing both ends of latch 30 in compression and transferring some of the longitudinal load to the adjacent finger 103, the latch is able to support a greater load than would be the case if it were only supported at one end. This in turn eliminates the need to provide a latch assembly 150 at each pipe position along the slot and allows each slot to be closed with a single latch if desired. In other words, because the present latch assembly 150 can support the upper ends of multiple pipe stands, the present system may eliminate the need for multiple latch assemblies along the length of each slot 105. Thus, the fingerboard latching mechanism disclosed herein is compact and lightweight, making it ideally suited for the onshore oil-rig market.

Operation

The following outline of steps illustrates an exemplary scenario that could be implemented using a system consistent with the present disclosure.

Open/Close Function:

1. To retrieve a desired tubular from a slot 105 on the racking board, an Open command is sent from the user or from the rig's control system.
2. Pipe sensor 140 determines whether latch 30 is clear to open and that no tubulars are leaning against latch 30.
3. If latch 30 is clear to open, the rig control system sends a signal to actuator 145.
4. Actuator 145 extends, causing latch 30 to rotate about the pivot pin from a closed position to an open position (FIG. 4).
5. The open actuator position sensor 147 detects that latch 30 is open and sends feedback to the control system.
6. The rig crew or pipe handling equipment retrieves the desired tubular from the slot.
7. Once the desired tubular has been retrieved, the control system stops sending the signal to extend actuator 145, whereupon latch 30 lowers by springs or gravity, until the close actuator sensor, second sensor 148, detects that latch 30 is in the closed position (FIG. 5), and sends feedback to the control system that latch 30 is closed.

Pipe Impact Function:

1. If wind or other force causes one or more stored tubulars to fall against latch 30, the resulting force on latch 30 causes latch 30 to slide outward toward the ends of fingers 103 (to the right as drawn in FIG. 3), compressing spring 144 if present, until the force is fully transferred to second and fourth bearing faces 134, 138.
2. Pipe sensor 140 detects that a tubular is near latch 30 and sends a signal to the control system.
3. If it is desired to retrieve a tubular from a slot whose pipe sensor indicates that a tubular is resting against the latch, the control system instructs the rig's pipe handling equipment to take alternate steps. The alternate steps might include having the pipe handling equipment push the tubular back to its normal resting position (away from latch 30) prior to opening latch 30 and engaging the tubular. Alternatively, the pipe handling equipment may engage the tubular that is resting against latch 30.

The pipe impact logic applies similarly if latch 30 is impacted by a tubular outside of slot 105. Specifically, latch 30 can bear a load from outside the slot (to the left as drawn in FIG. 3) by sliding along the mounting pin away from the ends of fingers 103, compressing spring 142 if present, until the force is fully transferred to first and third bearing faces 132, 136.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

What is claimed is:

1. A fingerboard, comprising:

a first finger having a longitudinal axis and proximal and distal ends;

a latch assembly mounted on the distal end of the finger, the latch assembly comprising:

first and second opposed bearing faces defining a first gap therebetween;

a latch having first and second latch ends, the first latch end being pivotably mounted in the first gap so as to allow the latch to pivot between open and closed positions; and third and fourth opposed bearing faces defining a second gap therebetween, the second gap positioned to receive an end of a second latch.

2. The fingerboard of claim 1, wherein the latch assembly includes a pin parallel to the longitudinal axis and the first latch end includes a bore, and wherein the first latch end is pivotably mounted on the first finger by engagement of the pin with the bore.

3. The fingerboard of claim 1, wherein the longitudinal dimension of the first gap is greater than the longitudinal dimension of the first latch end.

4. The fingerboard of claim 3, further including a first centralizer positioned between the first bearing face and the first latch end and a second centralizer positioned between the second bearing face and the first latch end.

5. The fingerboard of claim 1, comprising multiple fingers, wherein each finger includes a single latch assembly.

6. The fingerboard of claim 1, wherein the latch assembly is releasably mounted on the finger.

7. The fingerboard of claim 1, further including a control system and a pipe sensor mounted on the first finger and having a sensing range such that a pipe received in the slot and in contact with the latch is within the sensing range of the pipe sensor, the pipe sensor being in communication with the control system.

8. The fingerboard of claim 7, further including a latch actuator connected to the latch such that when latch actuator is actuated, it causes the latch to move to an open position and further including a sensor for sending a signal indicative of the latch position to the control system.

9. The fingerboard of claim 1, wherein the latch is formed from a material having an elastic modulus of between 30 and 1000 MPa.

10. The fingerboard of claim 1, wherein the latch pivots between the open and closed positions in a plane normal to the longitudinal axis of the first finger.

11. A fingerboard, comprising:

a first finger having a longitudinal axis, a pin, and first and second opposed bearing faces, the pin extending between the first and second bearing faces;

a first latch having first and second latch ends, the first latch end including a bore and being pivotably mounted between the first and second bearing faces by engagement of the pin with the bore so as to allow the latch to pivot between open and closed positions, the distance between the first and second bearing faces being greater than the longitudinal dimension of the first latch end;

a second finger parallel to the first finger and defining a slot therewith, the second finger including third and fourth bearing faces positioned such that when the latch is in a closed position the second latch end lies between the third and fourth bearing faces;

a control system; and a latch actuator connected to the latch such that when latch actuator is actuated, it causes the latch to move to an open position.

12. The fingerboard of claim 11, further comprising a first centralizer positioned between the first bearing face and the first latch end and a second centralizer positioned between the second bearing face and the first latch end.

13. The fingerboard of claim 11, further comprising a pipe sensor mounted on the first finger and having a sensing range such that a pipe received in the slot and in contact with the latch is within the sensing range of the pipe sensor, the pipe sensor being in communication with the control system.

14. The fingerboard of claim 11, wherein the pin is substantially parallel to the longitudinal axis.

15. The fingerboard of claim 11, wherein the latch pivots between the open and closed positions in a plane normal to the longitudinal axis of the first finger.

16. The system according to claim 11, further including a sensor for sending a signal indicative of the latch position to the control system.

17. A method for storing tubulars at a drill site, comprising:

providing a fingerboard comprising:

a first finger having a longitudinal axis;

a latch having first and second latch ends, the first latch end being pivotably mounted on the first finger so as to allow the latch to pivot between open and closed positions;

a second finger parallel to the first finger and defining a slot therebetween, the second finger including bearing faces defining a second gap therebetween and positioned such that when the latch is in a closed position the second latch end lies in the second gap;

opening the latch;

inserting one end of a tubular into the slot between the first and second fingers;

and closing the latch.

18. The method of claim 17, wherein the first finger includes a pin parallel to the longitudinal axis and the first latch end includes a bore, and wherein the first latch end is pivotably mounted on the first finger by engagement of the pin with the bore.

19. The method of claim 17, wherein the first finger includes first and second opposed healing faces defining the first gap therebetween and wherein the longitudinal dimension of the first gap is greater than the longitudinal dimension of the first latch end.

20. The method of claim 19, further including a first centralizer positioned between the first bearing face and the first latch end and a second centralizer positioned between the second bearing face and the first latch end.

21. The method of claim 17, further including a control system and a pipe sensor mounted on the first finger having a sensing range such that a pipe received in the slot and in contact with the latch is within the sensing range of the pipe sensor, the pipe sensor being in communication with the control system.

22. The method of claim 21, further including a latch actuator connected to the latch such that when latch actuator is actuated, the latch actuator causes the latch to move to an open position, and further including a sensor for sending a signal indicative of the latch position to the control system.

23. The method of claim 17, wherein each finger has a single latch releasably mounted thereon.

24. The method of claim 17, wherein the latch pivots between the open and closed positions in a plane normal to the longitudinal axis of the first finger.

* * * * *